US012139288B2

(12) United States Patent
Schoen

(10) Patent No.: US 12,139,288 B2
(45) Date of Patent: Nov. 12, 2024

(54) PACKAGING MACHINE COMPRISING AN INTEGRATED CLEANING AID

(71) Applicant: Bizerba SE & Co. KG, Balingen (DE)

(72) Inventor: Thomas Schoen, Balingen (DE)

(73) Assignee: BIZERBA SE & CO. KG, Balingen (DE)

( * ) Notice: Subject to any disclaimer, the term of this patent is extended or adjusted under 35 U.S.C. 154(b) by 240 days.

(21) Appl. No.: 17/686,429

(22) Filed: Mar. 4, 2022

(65) Prior Publication Data

US 2022/0297866 A1 Sep. 22, 2022

(30) Foreign Application Priority Data

Mar. 17, 2021 (EP) ..... 21 163 238.5

(51) Int. Cl.

| | |
|---|---|
| ***B65B 59/00*** | (2006.01) |
| ***B65B 1/32*** | (2006.01) |
| ***B65B 11/02*** | (2006.01) |
| ***B65B 35/24*** | (2006.01) |
| ***B65B 57/12*** | (2006.01) |
| ***B65B 59/04*** | (2006.01) |

(52) U.S. Cl.

CPC ..... *B65B 59/00* (2013.01); *B65B 1/32* (2013.01); *B65B 11/02* (2013.01); *B65B 35/24* (2013.01); *B65B 57/12* (2013.01); *B65B 59/04* (2013.01)

(58) Field of Classification Search

CPC ..... B65B 59/00; B65B 11/02; B65B 35/24; B65B 57/12; B65B 59/04; B65B 1/32

See application file for complete search history.

(56) References Cited

U.S. PATENT DOCUMENTS 4,458,470 A * 7/1984 Fine ..... B65B 11/54 53/502
4,543,766 A * 10/1985 Boshinski ..... G01G 19/40 53/64
4,615,757 A * 10/1986 Treiber ..... B65C 9/36 156/542
4,951,447 A * 8/1990 Denda ..... B65B 11/54 53/131.2

(Continued)

FOREIGN PATENT DOCUMENTS

CN 108820279 A 11/2018
EP 0912395 A2 5/1999

(Continued)

*Primary Examiner* — Thomas M Wittenschlaeger
*Assistant Examiner* — Katie L Gerth
(74) *Attorney, Agent, or Firm* — LEYDIG, VOIT & MAYER, LTD.

(57) ABSTRACT

A packaging machine is for packaging articles with a film. The packaging machine has: a housing; an infeed belt configured to feed an article to be packaged in a transport direction to a film packaging device in the packaging machine; and a weighing device configured to determine a weight of the article. The weighing device has a weighing belt configured to convey the article from the weighing device to the infeed belt in the transport direction. The weighing device is rigidly connected to the infeed belt. The weighing device and the infeed belt together form an infeed module that is removeable from the housing. The removable infeed module has a shared fastener for being releasably fastened to the housing.

15 Claims, 14 Drawing Sheets

(56) References Cited

U.S. PATENT DOCUMENTS 5,157,903 A * 10/1992 Nakashima ..... B65C 9/46 493/476
5,205,104 A * 4/1993 Nakashima ..... B65B 11/54 53/64
5,473,861 A * 12/1995 Fukunaga ..... B65B 11/54 53/228
5,501,066 A * 3/1996 Errasti Iriarte ..... B65B 57/12 53/221
5,855,106 A * 1/1999 Koyama ..... B65B 41/12 53/64
5,970,686 A * 10/1999 Demarest ..... B65B 63/04 53/118
6,484,475 B1 * 11/2002 Neagle ..... B65B 59/04 53/251
6,895,728 B2 * 5/2005 Kondo ..... B65B 11/54 53/466
7,313,894 B2 * 1/2008 Mise ..... B65C 9/36 53/64
8,631,555 B1 * 1/2014 Favale ..... B65B 59/04 29/525.01
9,394,071 B2 * 7/2016 Yamasita ..... B65C 9/42
9,776,747 B2 * 10/2017 Takahashi ..... B65B 57/04
9,938,028 B2 * 4/2018 Koyama ..... B65B 45/00
10,035,613 B2 * 7/2018 Ono ..... B29C 65/7891
10,822,127 B2 * 11/2020 Tai ..... B65B 49/00
11,046,467 B2 * 6/2021 Hayashi ..... B65H 20/06
2002/0055803 A1 * 5/2002 Stork ..... B65B 9/067 53/550
2006/0272283 A1 * 12/2006 Kawanishi ..... B65B 11/54 53/76
2007/0022715 A1 * 2/2007 Wegner ..... B65B 25/14 53/167
2012/0289388 A1 11/2012 Ehrmann et al.
2017/0349312 A1 * 12/2017 Lazor ..... B65B 59/001
2018/0105307 A1 * 4/2018 Guzman ..... B65B 41/12
2018/0118397 A1 * 5/2018 Blackford ..... B65B 61/26
2019/0144153 A1 * 5/2019 Schaub ..... F16P 1/02 53/410
2022/0297866 A1 * 9/2022 Schoen ..... B65B 35/24

FOREIGN PATENT DOCUMENTS

EP 2110219 A1 10/2009
EP 2800699 A1 11/2014
EP 3597383 A1 1/2020
EP 3587283 B1 7/2020
EP 3587289 B1 7/2020
EP 3611100 B1 7/2020
EP 3613676 B1 3/2021
WO WO 9800336 A2 1/1998
WO WO 2013102682 A1 7/2013

* cited by examiner

PACKAGING MACHINE COMPRISING AN INTEGRATED CLEANING AID

CROSS REFERENCE TO RELATED APPLICATIONS

This application claims benefit to European Patent Application No. EP 21163238.5, filed on Mar. 17, 2021, which is hereby incorporated by reference herein.

FIELD

The invention relates to a packaging machine for packaging articles having an integrated cleaning aid.

BACKGROUND

A packaging machine is described in EP 3 611 100 B1, for example. In particular, EP 3 611 100 B1 discloses a packaging machine in which films are folded toward the underside of a tray by left, right, and rear folding plates or slides. Both the side slides and the rear slide are fastened to the machine frame by means of at least one damping element. The damping element is configured such as to prevent, or at least lessen, transmission of mechanical vibrations of the side slides and the rear slide to the machine frame. As a result, the weighing value of articles is not distorted, or is only distorted within a reasonable tolerance range, even at high packaging speeds.

EP 3 587 289 B1 discloses a film transport apparatus for a packaging machine, in which, during the infeed to the film transport apparatus, films are inserted between transport rings and come into contact with the transport rings by static friction. The transport rings can convey the films onward until they are taken over by transport belts. As a result, the stability of the process of inserting the film into the film transport apparatus is increased.

EP 3 587 283 B1 discloses a packaging machine comprising two belt conveyor devices and a guide plate having a plurality of recesses, one of the belt conveyor devices being insertable into the recesses, such that the packaging machine is relatively simple to convert to film rolls of varying widths.

EP 3 613 676 B1 describes a packaging machine comprising a blade device provided with a return mechanism, which can be activated when the blade device transfers from an idle position into an extended position. The return mechanism brings about a return of the blade device without the intervention of the drive of the blade device, preferably automatically.

SUMMARY

In an embodiment, the present disclosure provides a packaging machine that is for packaging articles with a film. The packaging machine has: a housing; an infeed belt configured to feed an article to be packaged in a transport direction to a film packaging device in the packaging machine; and a weighing device configured to determine a weight of the article. The weighing device has a weighing belt configured to convey the article from the weighing device to the infeed belt in the transport direction. The weighing device is rigidly connected to the infeed belt. The weighing device and the infeed belt together form an infeed module that is removeable from the housing. The removable infeed module has a shared fastener for being releasably fastened to the housing.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1A:
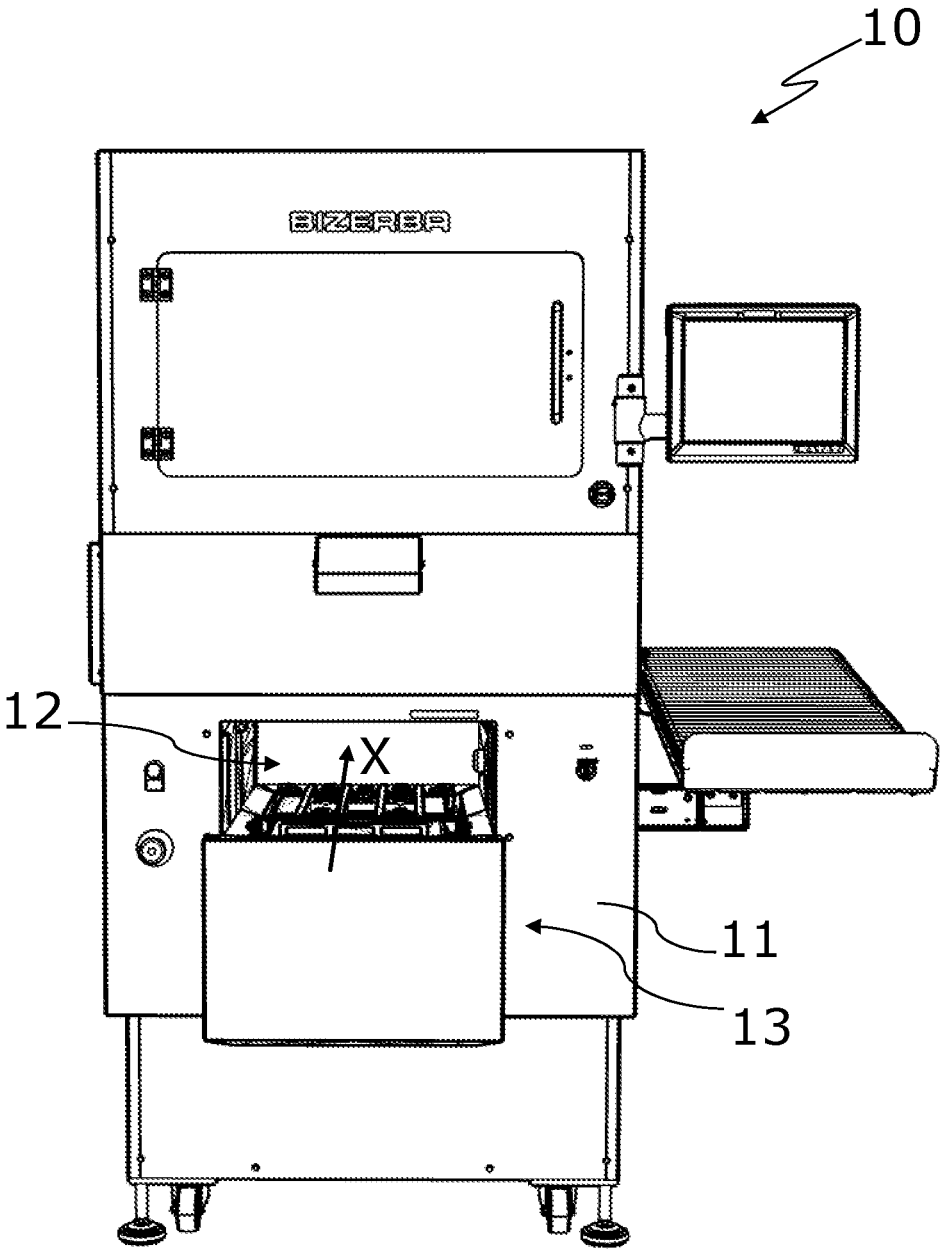
FIG. 1*a* is an isometric view of a packaging machine for packaging articles by means of a film, together with an infeed module according to an embodiment of the invention.

In packaging machines, the inner chamber in which the operation of packaging articles in film takes place is relatively difficult to clean. By contrast, an aspect of the invention is to provide a packaging machine in which the inner chamber can be cleaned particularly simply, especially in the region of the product infeed, with the simplest possible modifications.

The present disclosure, therefore, relates to a packaging machine for packaging articles by means of a film, comprising a housing, an infeed belt for feeding an article to be packaged in a transport direction to a film packaging device in the packaging machine, and a weighing device for determining the weight of each article.

In a generic packaging machine of the type described above, improvements to a packaging machine are achieved, according to embodiments of the invention, in a technically extremely simple and surprisingly effective way, in that the weighing device has a weighing belt for conveying the article from the weighing device to the infeed belt in the transport direction, and in that the weighing device is rigidly connected to the infeed belt, the weighing device and the infeed belt together forming an infeed module feed that can be removed from the housing, and the removable infeed module having a shared fastening means for being releasably fastened to the housing, such that the weighing device and the infeed module together form a compact infeed module that is simple to remove from the housing and also simple to fit back on in one piece.

According to an aspect of the present invention, it is not only the weighing belt that is withdrawn from the machine, but also the weighing belt together with the conveyor belts, which normally protrude as far as into the lifting platform.

Many machines from the prior art do not recognize this distinction and instead have just one belt, on which the weighing is then also carried out.

In addition to the weighing belt being separate from the infeed belt, the weighing device in accordance with an aspect of the invention typically has a load cell that is connected to the weighing belt and by which the weight of the article lying on the weighing belt is determined.

In the film packaging device, the article is wrapped in film. The "infeed module" should in particular be construed as a component of the packaging machine that both allows an article to be weighed and allows the article to be fed from the exterior into the interior of the packaging machine in order to package the article in film. To gain access to the inner chamber of the packaging machine, it is advantageously sufficient merely to detach the infeed module from the housing of the packaging machine. The inner chamber, in particular the product infeed, can then be cleaned. The housing typically has a receptacle into which the infeed module is inserted.

An advantageous embodiment of the packaging machine according to the invention is distinguished by the fact that the weighing device and the infeed belt have a shared support for forming the infeed module. The shared support is preferably formed by struts, tubes, and/or as a frame. The weighing device and the infeed belt are preferably rigidly connected to the shared support. The shared support gives the infeed module high stability.

A further embodiment is characterized in that the fastening means are designed for fastening the infeed module to the housing so as to be releasable without the use of tools. For this purpose, the fastening means can comprise resilient elements that can be bent by hand. By means of a fastening means of this kind, the infeed module can be detached from the housing of the packaging machine particularly simply and quickly.

In one group of other advantageous embodiments of the invention, the infeed module comprises first slide surfaces for bearing on a bearing surface of the housing when the infeed module is pushed into the housing. In particular, in a first configuration the receptacle comprises the receiving surface. The first slide surfaces are preferably configured as rails on which the infeed module slides.

A development of the aforementioned embodiments is distinguished by the fact that slide rails for abutting corresponding second slide surfaces of the infeed module are formed on the bearing surface of the housing. In particular, in a second configuration the receptacle encompasses the slide rails on the receiving surface. The second slide surfaces are in particular perpendicular to the first slide surfaces and are preferably formed as metal rails.

A further advantageous configuration of the film transport apparatus is characterized in that the infeed module has guide bolts, which engage in corresponding guide-bolt receptacles in the housing in order to guide the infeed module when the infeed module is pushed into the housing. The, in particular tubular, guide bolts, which are arranged laterally on the infeed module when the infeed module is in the fitted state, are used to orient the infeed module when it is pushed into the housing of the packaging machine.

In a further embodiment of the packaging machine according to the invention, the infeed module has a plug for insertion into a corresponding plug socket in the housing in order to fasten the infeed module to the housing, the plug preferably having a guide pin for being pushed into a corresponding guide-pin receptacle in the housing. In particular, the plug comprises resilient elements, which latch in the plug socket when the infeed module is pushed into the housing of the packaging machine. As a result, the infeed module is fastened to the housing in a simple manner.

In embodiments arranged in the geometrically opposite way but having an equivalent action, the infeed module can have a guide-pin receptacle in the form of a plug socket. The housing then has a plug corresponding thereto for insertion into the plug socket of the infeed module. In both embodiments, the plug can be used as a current or voltage supply.

An advantageous configuration of the packaging machine according to an embodiment of the invention is characterized by a removable cover for covering the infeed module, the cover in particular having eyes for being releasably mounted on eye retainers of the housing of the packaging machine. The cover protects the infeed module and the inner chamber of the packaging machine from external influences and from dirt. The cover has walls, which are in particular perpendicular to one another and engage around at least the weighing device on three sides when the cover is arranged on the infeed module.

A development of the aforementioned configuration is distinguished by the fact that a sensor, in particular a magnet sensor, is provided on the housing, by means of which sensor it is possible to detect whether or not the cover is currently fastened to the housing of the packaging machine.

A counterpiece to the sensor is preferably arranged on the cover and is detected by the sensor whenever the cover is arranged on the housing. In particular, a magnet is located on the cover and is detected by a magnet sensor when the cover is attached to the housing. The packaging machine preferably ends the packaging operation automatically as soon as the cover is taken off the housing.

A preferred embodiment of the packaging machine according to the invention is characterized by guide elements on the housing of the packaging machine for guiding the infeed module, the guide elements projecting from the housing of the packaging machine. The guide elements are in particular formed as rails that project perpendicularly from the housing of the packaging machine. When being pushed in, the infeed module slides along between the guide elements, which abut the infeed module. The guide elements orient the infeed module as it is pushed in. As a result, the guide elements ensure that the infeed module is pushed in properly.

A development of this embodiment is characterized by latching bolts of the infeed module for engaging in respective corresponding latching-bolt receptacles in the guide elements on the housing of the packaging machine. The latching bolts are used to secure the module in the guide element and preferably have a spring mechanism for unlocking and/or locking the infeed module on the housing of the packaging machine.

The locking when the infeed module is pushed in preferably takes place automatically. This can be brought about in particular by the spring mechanisms of the latching bolts. The latching-bolt receptacles are in particular formed as openings in the guide elements.

In embodiments of the invention, it is advantageous to have a protective bracket for setting down the infeed module, on which protective bracket the infeed module can in particular be set down when it has been taken out of the packaging machine. When the infeed module is in the fitted state, the protective bracket is in particular arranged below the weighing device on the infeed module. The protective bracket preferably has a U-shaped profile. The infeed module is preferably set down on the protective bracket and a rear edge of the infeed module. The aforementioned latching bolts are normally formed on the protective bracket.

Preferably, the infeed belt of the packaging machine according to an embodiment of the invention has conveyor belts, arranged next to one another, for transporting the article. Said conveyor belts can in particular engage in a lifting platform of the packaging machine.

In particular, the lifting platform has columns for transporting the article against the film, the conveyor belts being arranged between the columns when the infeed belt is in the fitted state. The article is conveyed by the conveyor belts onto the lifting platform, which then moves the article against the film for the folding operation.

An advantageous embodiment of the packaging machine according to the invention is characterized in that, to transport the article from the weighing belt to the infeed belt, a sliding plate is arranged between the infeed belt and the weighing belt. The sliding plate abuts the infeed belt at one end and the weighing belt at the other end. The article slides over said sliding plate when being conveyed from the weighing belt to the infeed belt.

A preferred variant of the packaging machine has a protective plate for the weighing belt, the protective plate in particular being releasably fastened to the weighing belt by knurled-head screws. The protective plate protects the weighing belt and the interior of the packaging machines from external influences and from dirt. Said protective plate is simple to take out in order to convert the machine from an operating mode in which the packages are inserted manually to automatic loading of articles on the weighing belt.

Other features and advantages of the invention will be apparent from the following detailed description of embodiment examples of the invention with reference to the figures of the drawings, which show details essential to the invention, as well as from the claims. The various features can each be implemented either individually or together in various combinations in variants of the invention.

The schematic drawings illustrate example embodiments of the invention which will be described in more detail in the following description.

FIG. 1*a* is an isometric view of a packaging machine 10 for packaging articles by means of a film. The machine has a housing 11. An infeed module 13 for feeding articles in a transport direction X is located in a receptacle 12 of the housing 11.

Figure 1B:
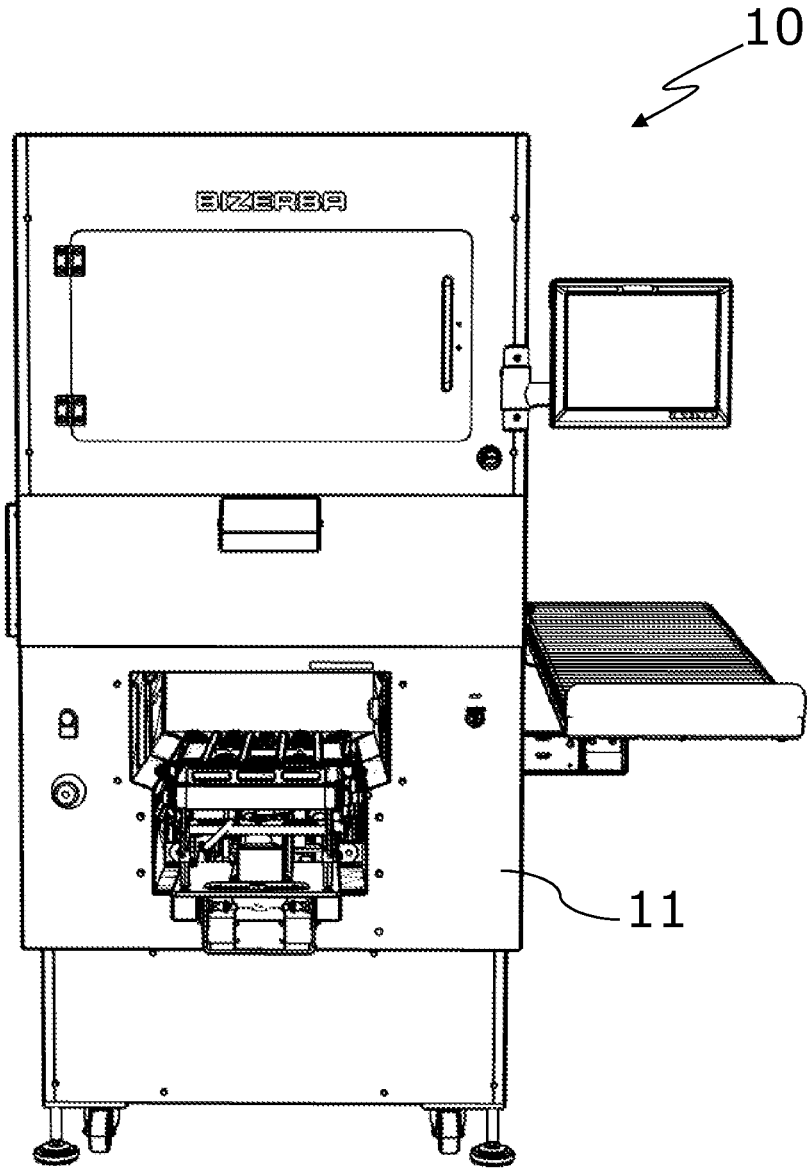
FIG. 1*b* is an isometric view of the packaging machine from FIG. 1*a* without the infeed module.

FIG. 1*b* shows the packaging machine 10 without the infeed module 13.

Figure 2A:
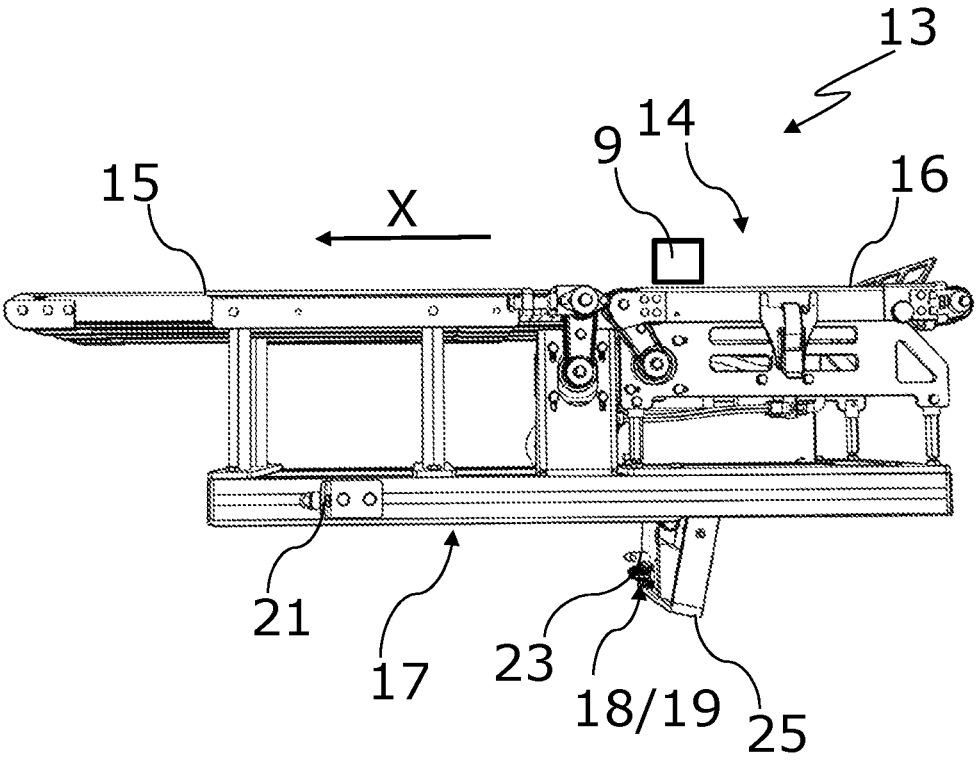
FIG. 2*a* is a side view of a first embodiment of the infeed module according to the invention.

FIG. 2*a* is a side view of a first embodiment of the infeed module 13. The infeed module 13 comprises a weighing device 14 for determining the weight of each article 9 and an infeed belt 15 for feeding an article 9 to be packaged in the transport direction X to a film packaging device in the packaging machine 10 (see FIGS. 1*a* and 1*b*).

The weighing device 14 has a weighing belt 16 for conveying the article 9 from the weighing device 14 to the infeed belt 15 in the transport direction X. To form the infeed module 13, the weighing device 14 and the infeed belt 15 are connected by means of a shared support 17.

The infeed module 13 is releasably connected to the housing 11 of the packaging machine 10 by means of a plug 18 acting as a shared fastening means 19 of the weighing device 14 and the infeed belt 15. For this purpose, the plug 18 is latched in a corresponding plug socket 20 of the housing (see FIG. 4*a*), in particular so as to be releasable without the use of tools. The plug 18 is primarily used for supplying current and voltage.

Guide bolts 21 of the infeed module 13 engage in corresponding guide-bolt receptacles 22 (see FIG. 4*a*) in the housing 11 for guiding the infeed module 13 when the infeed module 13 is pushed into the housing 11. A guide pin 23 serves for being pushed into a corresponding guide-pin receptacle 24 (see FIG. 4*a*) in the housing 11 for guiding the plug 18 as it is pushed into the plug socket 20.

The infeed module 13 can be set down on a protective bracket 25 when it has been taken out of the packaging machine 10.

Figure 2B:
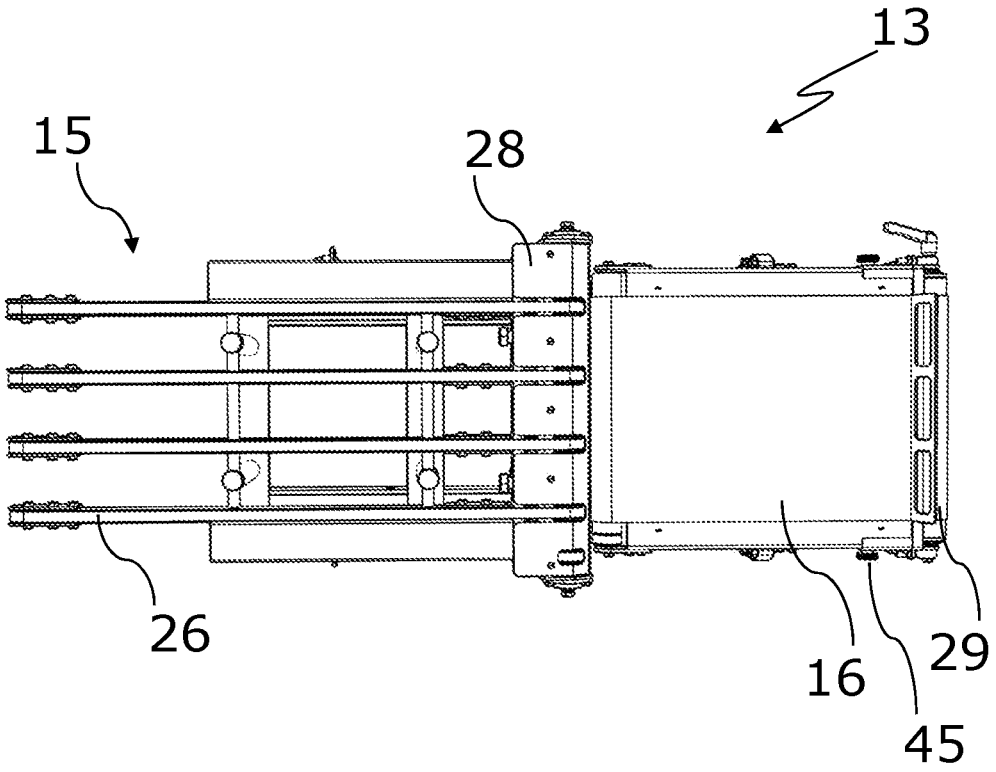
FIG. 2*b* is a plan view of the infeed module according to FIG. 2*a;*

FIG. 2*b* is a plan view of the infeed module 13 according to FIG. 2*a*. The infeed belt 15 has conveyor belts 26 for transporting the article 9 (see FIG. 2*a*), which are arranged next to one another and in particular engage in a lifting platform 27 of the packaging machine 10 (see FIG. 4*a*).

To transport the article 9 from the weighing belt 16 to the infeed belt 15, a sliding plate 28 is arranged between the infeed belt 15 and the weighing belt 16.

On the weighing belt 16 there is arranged a protective plate 29 for protecting the weighing belt 16 and the inner chamber of the packaging machine from external influences, the protective plate 29 being releasably fastened to the weighing belt 16 by knurled-head screws 45. The protective plate 29 also serves to protect operators, and additionally defines the reachable bearing region for the article 9 on the weighing belt 16.

Figure 2C:
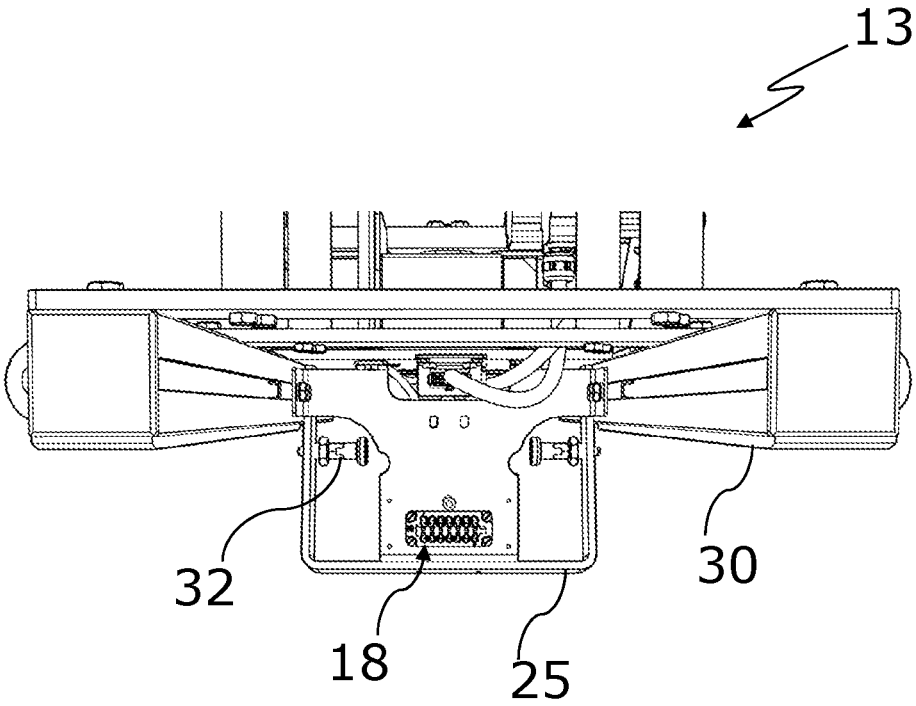
FIG. 2*c* shows the first embodiment of the infeed module in a view in the direction of the side facing the housing of the packaging machine.

FIG. 2*c* shows a first embodiment of the infeed module 13 in a view looking toward the side facing the housing 11 (see FIG. 1*a*) as the infeed module 13 is pushed in. First slide surfaces 30 of the infeed module are used for bearing on a bearing surface 31 (see FIG. 4*a*) of the housing 11 when the infeed module 13 is pushed into the housing 11.

Latching bolts 32 are fastened to the protective bracket 25 and engage in corresponding latching-bolt receptacles 33 (see FIG. 4*c*) of guide elements 34 on the housing 11 of the packaging machine, the latching bolts 32 having a spring mechanism for unlocking and/or locking the infeed module 13 on the housing 11 of the packaging machine 10.

Figure 2D:
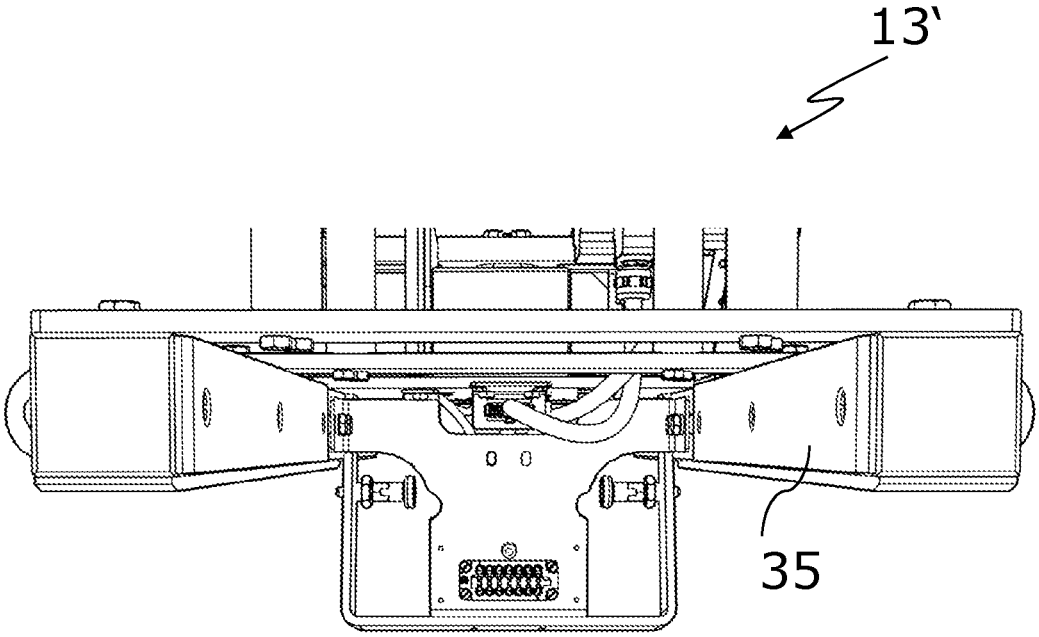
FIG. 2*d* shows a second embodiment of the infeed module in a view toward the side facing the housing.

FIG. 2*d* shows a second embodiment of the infeed module 13' in a view looking toward the side facing the housing 11 as the infeed module is pushed in. The second embodiment of the infeed module 13' has all the features of the first embodiment (see FIG. 2*c*). In addition, in the second embodiment, the infeed module 13' in this case comprises second slide surfaces 35 for abutting corresponding slide rails 36 of the housing 11 (see FIG. 4*b*).

Figure 2E:
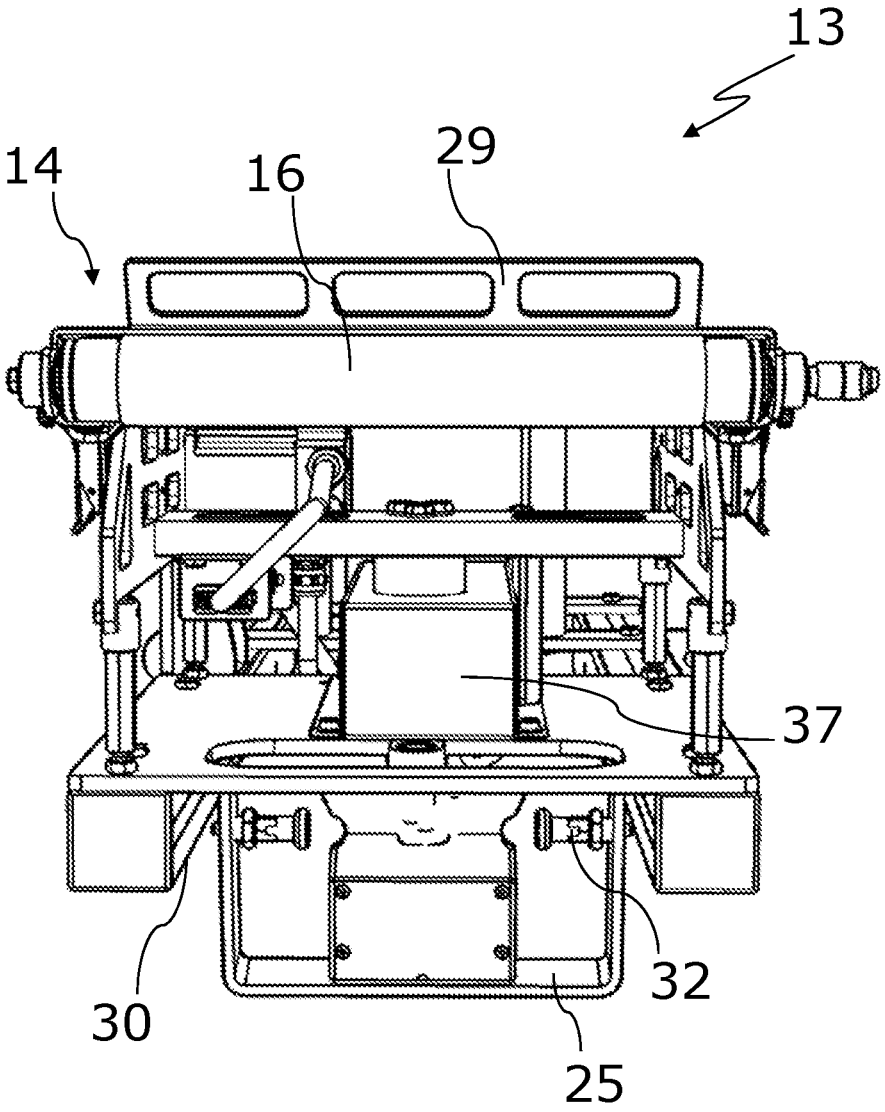
FIG. 2*e* shows the infeed module in the first embodiment in a view toward the side facing the exterior.

FIG. 2*e* shows the infeed module 13 in the first embodiment according to FIG. 2*a* in a view looking toward the side facing the exterior, with the infeed module 13 in the fitted state. The weighing device 14 has a load cell 37, which is connected to the weighing belt 16 in order to determine the weight of the article 9 (see FIG. 2*a*) on the weighing belt 16. Also shown are the protective bracket 25 having the latching bolts 32, the protective plate 29, and the first slide surfaces 30.

Figure 2F:
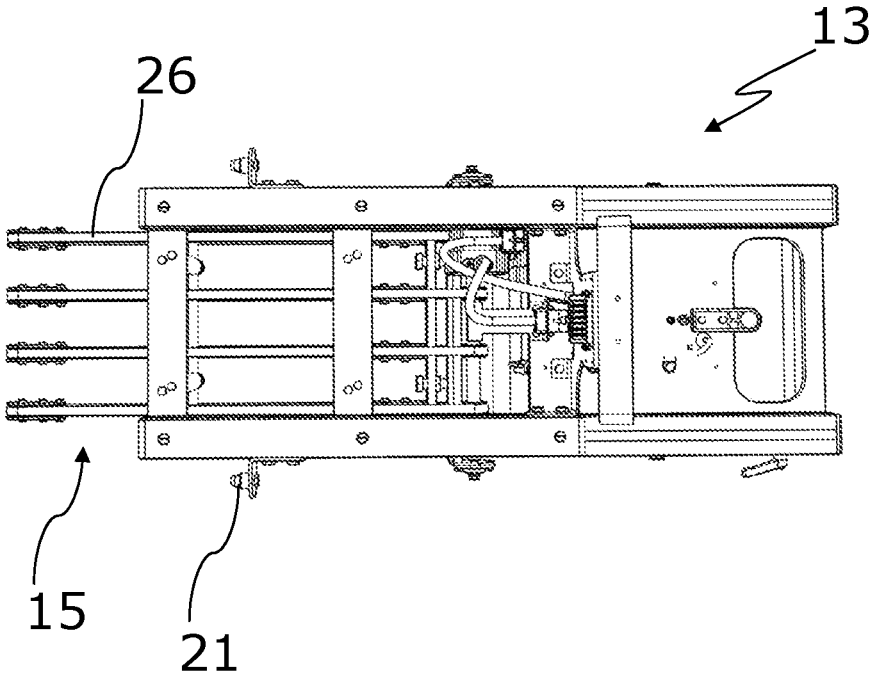
FIG. 2*f* shows the infeed module in a view from below.

FIG. 2*f* shows the infeed module 13 in a view from below, with the infeed module 13 in the fitted state. Among other things, the conveyor belts 26 of the infeed belt 15 and the guide bolts 21 are shown.

Figure 3A:
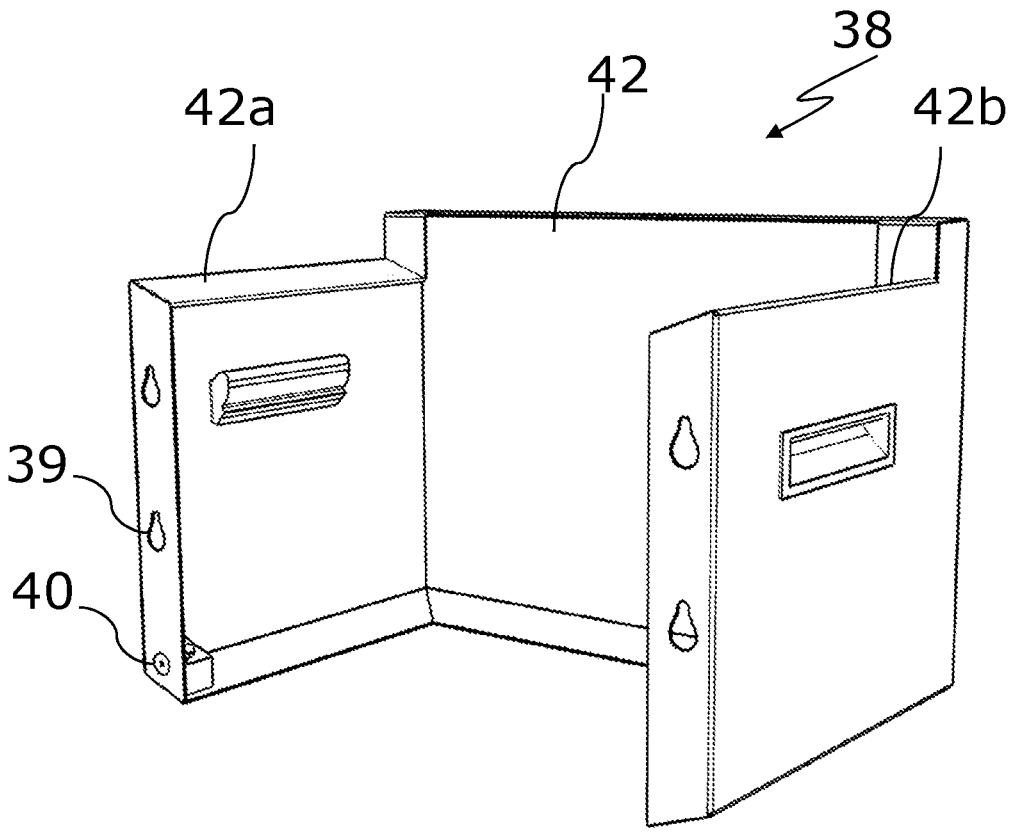
FIG. 3*a* shows a first embodiment of a removable cover for covering the infeed module.

FIG. 3*a* shows a first embodiment of a removable cover 38 for covering the infeed module 13 (see FIG. 2*a*). The cover 38 has eyes 39 for being releasably mounted on corresponding eye retainers 44 (see FIG. 4*a*; for example in the form of screws) of the housing 11 (see FIG. 1*a*) of the packaging machine 10.

The cover 38 has a magnet 40, which can be detected by a magnet sensor 41 (see FIG. 4*a*) on the housing 11 in order to indicate that the cover 38 is fastened to the housing 11 of the packaging machine 10.

In addition, the cover 38 has a rear covering plate 42, which faces away from the eyes 39 and the magnet sensor 41. When the cover 38 is in the fitted state, the covering plate 42 covers the weighing belt 16 in the vertical direction (see FIG. 2*a*) in order to protect the weighing belt, and also the inner chamber of the packaging machine 10, from external influences and dirt. The rear covering plate 42 between the side covering plates 42*a*, 42*b* is formed to be lower than the side covering plates 42*a*, 42*b* such that the covering plate 42 in particular only reaches as far as to below the weighing belt 16 when the cover 38 is in the fitted state (see FIG. 2*a*).

Figure 3B:
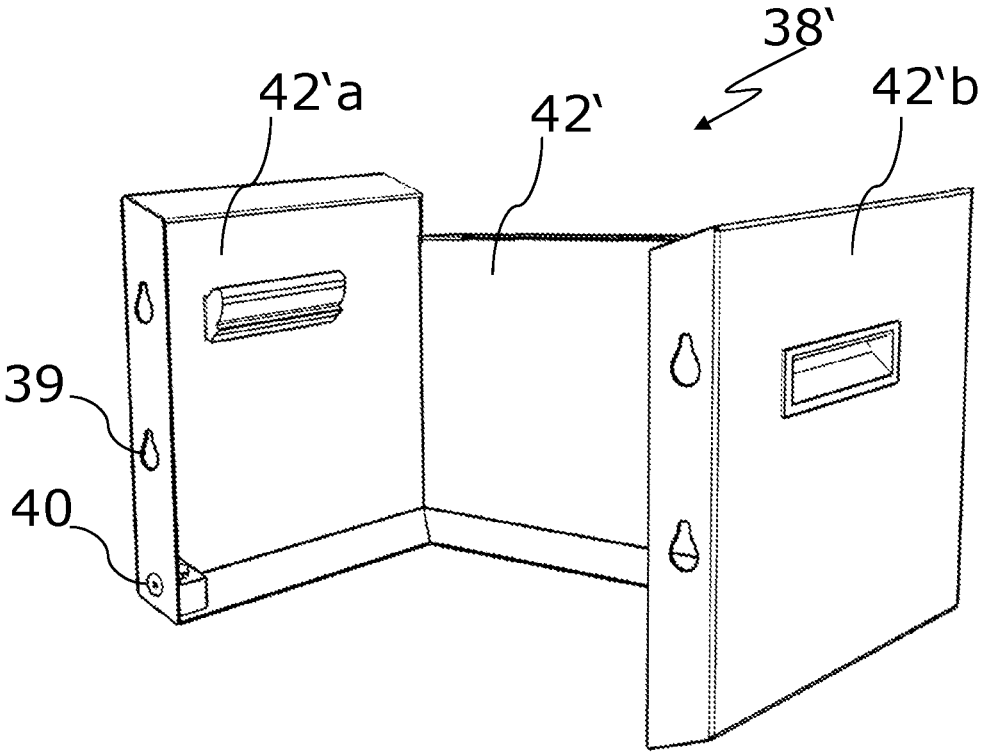
FIG. 3*b* shows a second embodiment of the removable cover.

FIG. 3*b* shows a second embodiment of the removable cover 38' together with the eyes 39 and the magnet 40. The rear covering plate 42' between the side covering plates 42'*a*, 42'*b* is again formed to be lower than the side covering plates 42'*a*, 42'*b* such that the covering plate 42' in particular only reaches as far as to below the weighing belt 16 when the cover 38' is in the fitted state (see FIG. 2*a*).

The covering plates 42; 42' protect the inner chamber of the packaging machine (see FIG. 1*a*) but allow articles 9 to be fed automatically onto the weighing belt 16 (see FIG. 2*a*) and to the packaging machine 10. The articles 9 are guided to the weighing belt 16 by means of a further conveying belt.

Figure 4A:
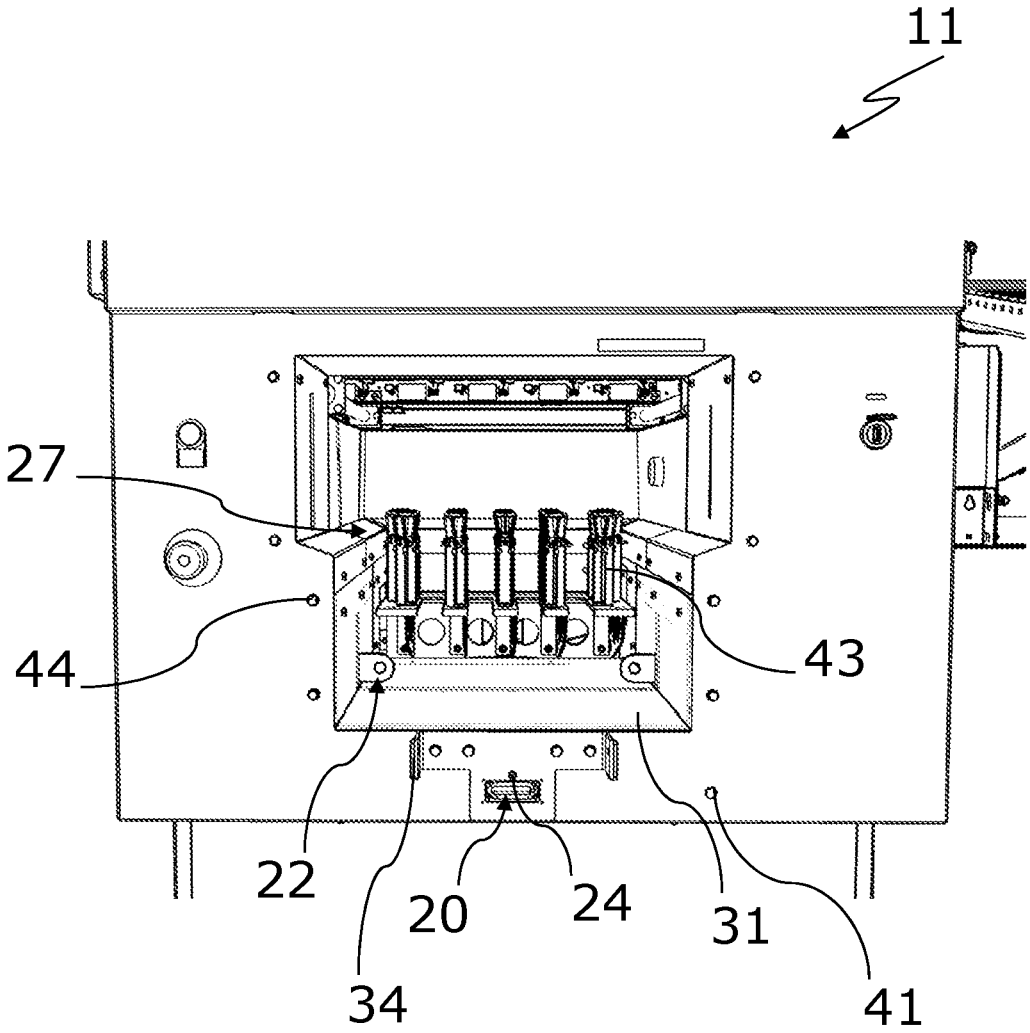
FIG. 4*a* shows a first embodiment of the housing of the packaging machine according to the invention.

FIG. 4*a* shows a first embodiment of the housing 11. The receptacle for the infeed module 13 (see FIG. 2*a*) has a bearing surface 31 for the first slide surfaces 30 (see FIG. 2*a*) of the infeed module 13. A lifting platform 27 has columns 43 for conveying each article 9 (see FIG. 2*a*) against the film, which is then folded around the article 9 by a folding mechanism.

The conveyor belts 26 (see FIG. 2*b*) are arranged between the columns 43 of the lifting platform 27 when the infeed module 13 is in the fitted state. They convey the article 9 onto the columns 43, which then transport the article 9 against the film.

Guide elements 34 on the housing 11 of the packaging machine 10 are used for guiding the infeed module 13, the guide elements 34 projecting from the housing 11 of the packaging machine 10.

Guide-bolt receptacles 22 serve to guide the guide bolts 21 (see FIG. 2*a*) of the infeed module 13. A plug socket 20 in the housing 11 is used for receiving the plug 18 (see FIG. 2*c*). To guide the guide pin 23 (see FIG. 2*a*) on the plug 18, a guide-pin receptacle 24 is formed in the housing 11. Also shown are the eye retainers 44, on which the eyes 39 of the cover 38 are mounted. A magnet sensor 41 detects the magnet 40 (see FIG. 3*a*) on the cover 38 when the cover 38 is arranged on the housing 11.

Figure 4B:
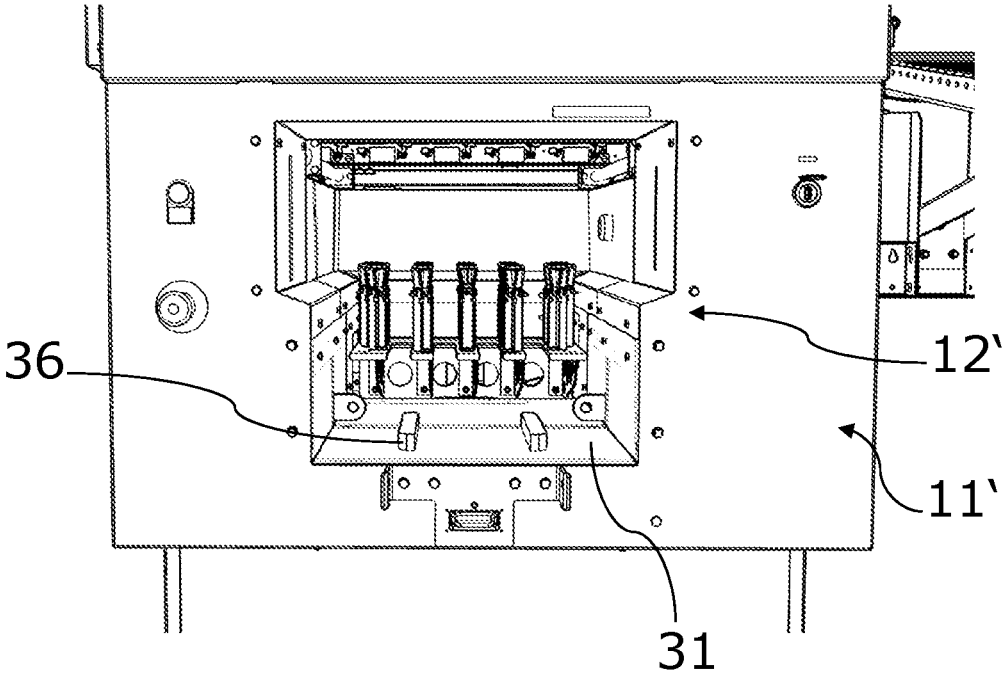
FIG. 4*b* shows a second embodiment of the housing.

FIG. 4*b* shows a second embodiment of the housing 11' having a second embodiment of the receptacle 12'. In this second configuration, the receptacle 12' has slide rails 36, along which the corresponding second slide surfaces 35 of the infeed module 13' slide in the second embodiment as the infeed module 13' is pushed in. The slide rails 36 are formed on the bearing surface 31 of the housing 11.

Figure 4C:
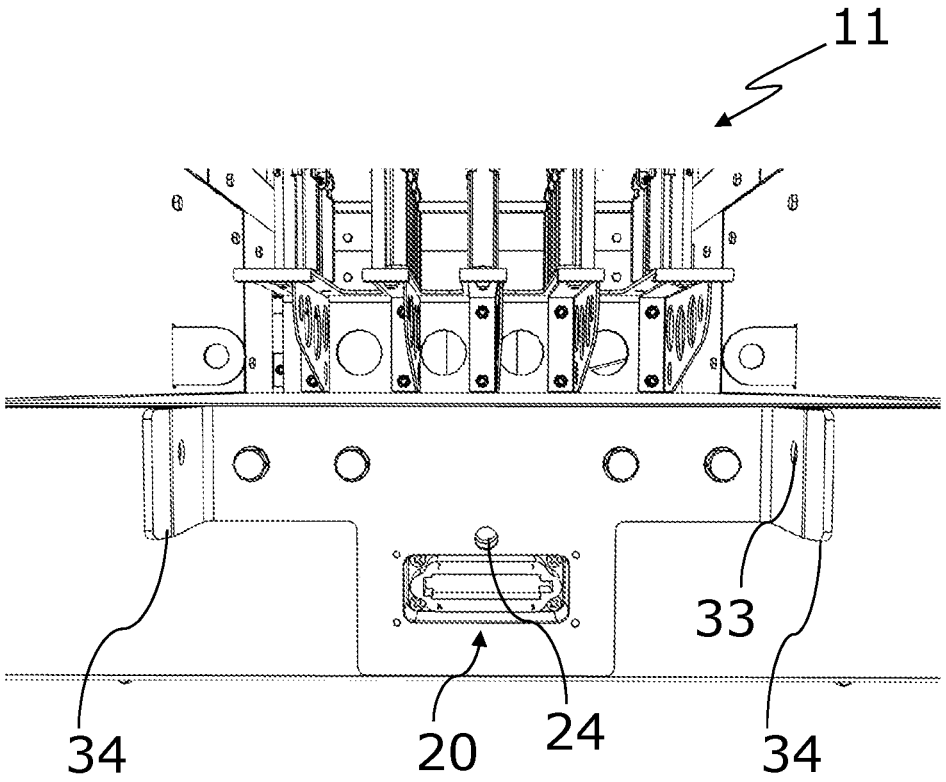
FIG. 4*c* is a detailed view of the housing having a plug socket.

FIG. 4*c* is a detailed view of the housing 11, showing the plug socket 20 and the guide-pin receptacle 24 as well as the guide elements 34 on the housing 11. The guide elements 34 have latching-bolt receptacles 33 for the latching bolts 32 of the infeed module 13 (see FIG. 2*c*).

Figure 4D:
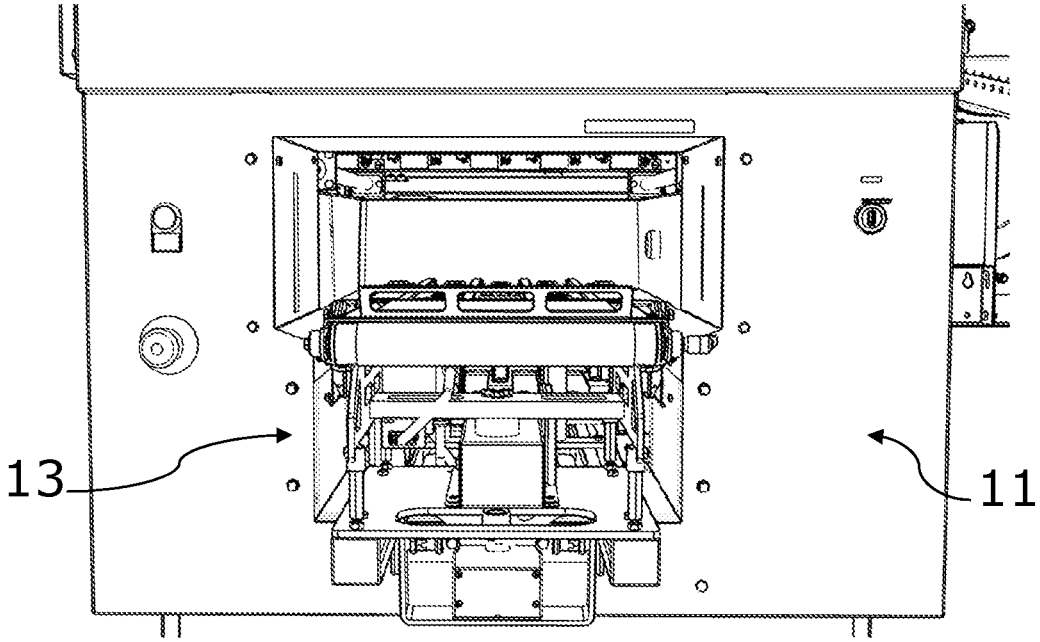
FIG. 4*d* shows the housing with the infeed module inserted and without the cover.

FIG. 4*d* shows the housing 11 with the infeed module 13 inserted and without the cover 38 (see FIG. 3*a*).

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

9 particle
10 packaging machine
11, 11' housing
12, 12' receptacle
13, 13' infeed module
14 weighing device
15 infeed belt
16 weighing belt
17 shared support
18 plug
19 shared fastening means
20 plug socket
21 guide bolt
22 guide-bolt receptacles
23 guide pin
24 guide-pin receptacle
25 protective bracket
26 conveyor belt
27 lifting platform
28 sliding plate
29 protective plate
30 first slide surfaces
31 bearing surface
32 latching bolt
33 latching-bolt receptacles
34 guide elements
35 second slide surfaces
36 slide rail
37 load cell
38 cover
39 eyes
40 magnet

41 magnet sensor
42; 42' rear covering plate
42*a*, 42*b*; 42'*a*, 42'*b* side covering plates
43 columns
44 eye retainers
45 knurled-head screws

The invention claimed is:

1. A packaging machine for packaging articles with a film, the packaging machine comprising:

a housing;

a lifting platform arranged within the housing, the lifting platform comprising columns configured for transporting an article against the film for a folding operation;

an infeed belt configured to feed the article to be packaged in a transport direction to a film packaging device in the packaging machine; and a weighing device configured to determine a weight of the article, wherein the weighing device comprises a weighing belt configured to convey the article from the weighing device to the infeed belt in the transport direction, wherein the weighing device is rigidly connected to the infeed belt, wherein the weighing device and the infeed belt together form an infeed module that is removeable as unified component from the housing, wherein the removable infeed module has a shared fastener for being releasably fastened to the housing, the shared fastener being arranged such that the weighing device and the infeed belt are removeable from and installable into a fitted state in the packaging machine as the infeed module in a unified manner, wherein the weighing device and the infeed belt are rigidly connected by a shared support for forming the infeed module, and wherein the infeed belt comprises conveyor belts configured to transport the article. the conveyor belts being arranged next to one another, configured to engage in the lifting platform of the packaging machine in a condition where the infeed module is in the fitted state in the packaging machine, and configured to be arranged between the columns of the lifting platform in the fitted state.

2. The packaging machine according to claim 1, wherein the fastener is configured to fasten the infeed module to the housing so as to be releasable without the use of tools.

3. The packaging machine according to claim 1, wherein the infeed module has first slide surfaces configured to bear on a bearing surface of the housing in a condition where the infeed module is pushed into the housing.

4. The packaging machine according to claim 3, wherein slide rails configured to abut corresponding second slide surfaces of the infeed module are on the bearing surface of the housing.

5. The packaging machine according to claim 1, wherein the infeed module comprises guide bolts, which are configured to engage in corresponding guide-bolt receptacles in the housing for guiding the infeed module in a condition where the infeed module is being pushed into the housing.

6. The packaging machine according to claim 1, wherein the infeed module has a plug that is configured to be inserted into a corresponding plug socket in the housing in order to fasten the infeed module to the housing.

7. The packaging machine according to claim 6, wherein the plug has a guide pin that is configured to be pushed into a corresponding guide pin receptacle in the housing.

8. The packaging machine according to claim 1, wherein the packaging machine comprises a removable cover configured to cover the infeed module, the cover having eyes configured to be releasably mounted on eye retainers of the housing of the packaging machine.

9. The packaging machine according to claim 8, wherein a sensor is provided on the housing, the sensor being configured to detect whether the cover is fastened to the housing of the packaging machine.

10. The packaging machine according to claim 1, wherein the packaging machine comprises guide elements on the housing of the packaging machine that are configured to guide the infeed module during removal and installation such that the infeed module is automatically positioned into the fitted state where the conveyor belts engage in the lifting platform, the guide elements projecting from the housing of the packaging machine.

11. The packaging machine according to claim 10, wherein the packaging machine comprises latching bolts of the infeed module that are configured to engage in corresponding latching-bolt receptacles in the guide elements on the housing of the packaging machine.

12. The packaging machine according to claim 11, wherein the latching bolts have a spring mechanism for unlocking or locking the infeed module on the housing of the packaging machine.

13. The packaging machine according to claim 1, wherein a protective bracket is provided for setting down the infeed module such that the infeed module is configured to be set down when it has been taken out of the packaging machine.

14. The packaging machine according to claim 1, wherein, to transport the article from the weighing belt to the infeed belt, a sliding plate is arranged between the infeed belt and the weighing belt.

15. The packaging machine according to claim 1, wherein the packaging machine comprises a protective plate of the weighing belt, the protective plate being releasably fastened to the weighing belt.

* * * * *